US006657529B1

(12) United States Patent
Albach

(10) Patent No.: US 6,657,529 B1
(45) Date of Patent: Dec. 2, 2003

(54) MAGNETIC COMPONENT

(75) Inventor: Manfred Albach, Neuenkirchen am Brand (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 145 days.

(21) Appl. No.: 09/624,475

(22) Filed: Jul. 24, 2000

(30) Foreign Application Priority Data

Jul. 23, 1999 (DE) ..... 199 34 767

(51) Int. Cl.[7] ..... H01F 27/28
(52) U.S. Cl. ..... 336/182; 336/178; 336/147
(58) Field of Search ..... 336/212, 233, 336/234, 214, 215, 220, 182, 180, 170, 178, 145–147

(56) References Cited

U.S. PATENT DOCUMENTS 4,464,544 A * 8/1984 Klein ..... 336/84 C
4,488,136 A * 12/1984 Hansen et al. ..... 336/215
4,574,222 A * 3/1986 Anderson ..... 336/173
4,766,365 A * 8/1988 Bolduc et al. ..... 336/178
4,837,497 A * 6/1989 Leibovich ..... 336/143

FOREIGN PATENT DOCUMENTS

WO 8102648 A1 9/1981

OTHER PUBLICATIONS

Patent Abstracts of Japan, "Inductance Apparatus", Publication No. 61047605, Publication Date Mar. 8 1986.

* cited by examiner

*Primary Examiner*—Tuyen T. Nguyen

(57) ABSTRACT

The invention relates to a magnetic component having at least two windings electrically connected in series (3, 4, 13, 14, 24–27, 31–33) and a core (1, 2, 10, 11, 20–23, 30) on which the windings (3, 4, 13, 14, 24–27, 31–33) are arranged so that in the event of a current flow through the windings (3, 4, 13, 14, 24–27, 31–33) the generated magnetic stray fields outside the component at least partly compensate each other, the core having at least one inside limb portion and at least two outside limb portions and in that the windings (3, 4, 13, 14, 24–27, 31–33) are arranged on the inside limb portion and/or the outside limb portions.

5 Claims, 2 Drawing Sheets

MAGNETIC COMPONENT

FIELD OF TECHNOLOGY

The invention relates to a magnetic component.

BACKGROUND AND SUMMARY

Magnetic components (coils or transformers) are also provided for use in high frequency clocked electronic circuits, for example, parts of combinatorial circuits. In many electronic devices of the consumer electronics industry, parts of combinatorial circuits are used nowadays. A large problem is then caused by the electromagnetic disturbances resulting from the high-frequency switching mode. This problem becomes particularly serious when the parts of combinatorial circuits are built-in in monitors, television sets or audio sets, because the video and audio quality respectively may be influenced. More particularly radio reception is strongly affected in the long-wave and medium-wave range, because this frequency range lies in the neighborhood of switching frequencies or their first harmonics. To the most important noise sources belong the magnetic components which generate a very strong magnetic stray field.

A method usually implemented for reducing this magnetic stray field comprises creating a short-circuit winding around the coil or the transformer respectively, with the aid of a conductive foil, usually a copper strip. This method, however, is not at all sufficient for lowering the magnetic field to a level that is no longer detected by the medium-wave antenna of the audio device. A further efficient method comprises that the magnetic component is built-in in a closed screen housing. Added to the disadvantage of extra cost and weight is here particularly the poorer heat dissipation.

From WO 81/02648 (compare its FIG. 1) is known a magnetic component with a U core in which a winding is deposited on two opposite core limbs. When there is a current flowing through the windings, the generated stray fields are mutually partly compensating so that the resulting stray field outside the magnetic component is reduced.

SUMMARY OF THE INVENTION

It is an object of the invention to provide a further variant for a magnetic component, in which the generated stray field outside the component is minimized.

The object is achieved in that at least two windings electrically connected in series are provided and in that the magnetic component has a core on which the windings are arranged so that in the case of a current flowing through the windings, the generated magnetic stray fields outside the component at least partly compensate each other, while the core has at least one inside limb portion and at least two outside limb portions and the windings are arranged on the inside limb portion and/or the outside limb portions.

The desired effect of stray field reduction outside the magnetic component can be obtained with the aid of cores for magnetic components, for example, E or P cores which are customary in the market. A winding is then suitably subdivided so that spatially separated winding portions are formed which are no longer directly magnetically coupled i.e. the same magnetic flow no longer passes through them. Outside the magnetic component, an effective compensation of the magnetic fields generated by the respective windings can thus be achieved, so that the resulting magnetic stray field outside the component is largely minimized. There are component variants which can be manufactured cost effectively and effectively reduce the stray field. More particularly, the individual windings have, in essence, equal inductance values, so that with symmetrical component structures an optimum compensation of the generated stray fields outside the magnetic component is achieved. With asymmetric arrangements, however, different inductance values may regularly be selected.

In an embodiment of the invention, there are two cores which have corresponding inside and outside limb portions. The inside limb portions carry each a winding for guiding a magnetic flow and between the two core portions a third core portion is arranged which is I-shaped in cross-section. This embodiment is preferably realized by means of an E core between whose core halves the core portion having an I shape in cross-section is arranged.

Another variant of embodiment of the invention provides that two inside core portions are provided which have corresponding inside and outside limb portions pointing inwards, that on the outside of the inside core portions further core portions are arranged which have further inside and outside limb portions corresponding to the inside and outside limb portions of the inner core portions and that the windings are arranged on the inside core portions. This embodiment provides a further improved reduction of the stray field outside the magnetic component. The component core is preferably realized by means of two E cores i.e. by means of four E core halves lying on top of each other, whose inside and outside limb portions all point to the inside of the component.

A further reduction of the outside stray field may be achieved in that the outside limb portions of the core portions carry at least part of the windings. When the inside and outside limb portions of the core portions then carry windings, the stray field reduction is optimized further. The idea according to the invention, however, also includes the case where only the outside limbs carry windings. The invention also relates to a core for one of the variants of a magnetic component described above.

BRIEF DESCRIPTION OF THE DRAWING

Examples of embodiment of the invention will be further explained with reference to the drawings, in which.

DESCRIPTION OF THE PREFERRED EMBODIMENTS

Figure 1:
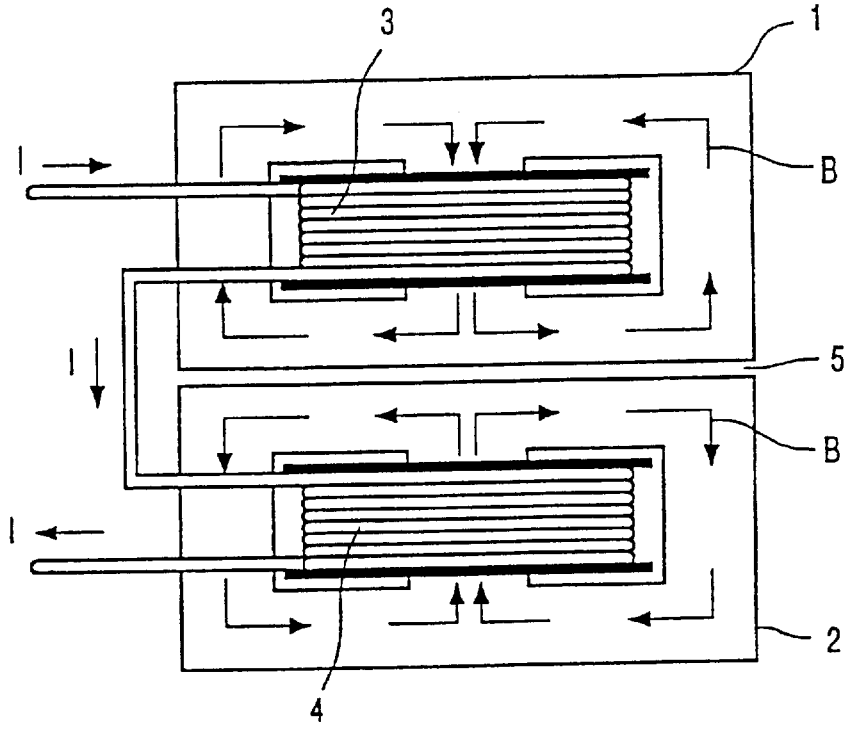
FIG. 1 shows a magnetic component according to the invention having a core comprising two E cores.

The magnetic component shown in FIG. 1, which is arranged as a coil here, has a core comprising two E cores 1 and 2. On the inside limb (portion) of the E core 1 is wound a winding 3 which is electrically connected in series to a winding 4, while the winding 4 is wound on the inside limb (portion) of the E core 2. The outside limb (portions) of the two E cores 1 and 2 have no windings. The two E cores 1 and 2 are arranged so that the inside and outside limb portions corresponding to each other lie opposite each other and their axes are running in parallel.

Furthermore, FIG. 1 shows for the case where a current I flows through the windings 3 and 4, the basic pattern of the magnetic flux generated by the flowing current. In the upper E core 1, the thus generated magnetic flux in the inside limb is directed from top to bottom, thus in the direction of the other E core 2. At the bottom of the inside limb of the E core 1, this flux is split up and is led here for one half to the left outside limb and for the other half to the right outside limb of the E core 1. The magnetic partial fluxes led via the two outside limbs are directed from bottom to top in the two outside limbs of the E core 1 and are united at the upper end of the inside limb of the E core 1 to the magnetic flux running through the inside limb, so that the magnetic circuit covered by the E core 1 is closed. Since the same current flows through the winding 4 as through the winding 3, and in the present case the two windings also have the same inductance values, the distribution of magnetic flux in E core 2 corresponds to the distribution of magnetic flux in the E core 1. However, the magnetic fluxes flowing through the inside or outside limb respectively of the E core 2 are oppositely directed, that is to say, the magnetic flux flowing through the inside limb of the E core 2 is directed from bottom to top on the magnetic partial fluxes in the outside limbs of the E core 2 are directed from top to bottom. In such a magnetic component the magnetic stray fields generated by the windings 3 and 4 largely compensate each other outside the magnetic component, so that the resulting magnetic stray field outside the magnetic component is reduced to a minimum.

Figure 2:
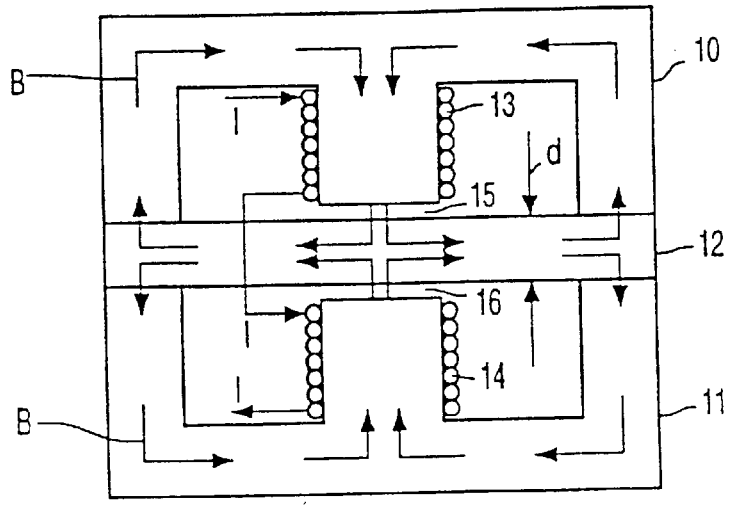
FIG. 2 shows a magnetic component according to the invention having a core comprising two E core halves and one I-shaped core half.

FIG. 2 shows a preferred embodiment of the magnetic component according to the invention with an intersection running through the magnetic component. In this variant of embodiment, a core with two E core halves 10 and 11 is provided, between which a core portion 12 having an I-shaped cross-section is arranged. The inside limb portion of the E core half 10 carries a winding 13 and the inside limb portion of the E core half 11 carries a winding 14. Similarly to the magnetic component shown in FIG. 1, also here the two windings are electrically connected in series. An air gap (references 15 and 16) is provided between the inside limb portions of the two respective core halves 10 and 11 and the core portion 12.

If a current I flows through the windings 13 and 14 (corresponds to the arrangement of windings 3 and 4 and the current flow shown in FIG. 1), as is shown in FIG. 2, the result is that in the inside limb of the core half 10 a magnetic flux is generated directed from top to bottom and pointing in the direction of the core half 11. The magnetic flux entering the core half 12 via the air gap 15 is led in the present symmetrical core arrangement in equal amounts in the direction of the left and right outside limb portions of the core halves 10 and 11. For optimizing the pursued compensation of the outside magnetic stray field, the thickness d of the core portion 12 is to be selected smallest possible, while the reduction of the thickness d has its limits where the generated losses in the core portion 12 are no longer acceptable, or the inductance values to be generated by means of the windings 13 and 14 are no longer realizable.

The embodiment as shown in FIG. 2 leads to a reduction of the outside magnetic stray field that can be compared to that of the embodiment shown, in FIG. 1. However, the embodiment shown in FIG. 2 offers the advantage that the core portions 10, 11 and 12 used are available as cost-effective mass-produced articles and for the core arrangement are used only, for example, an E core and a core portion having an I-shaped cross-section.

Figure 3:
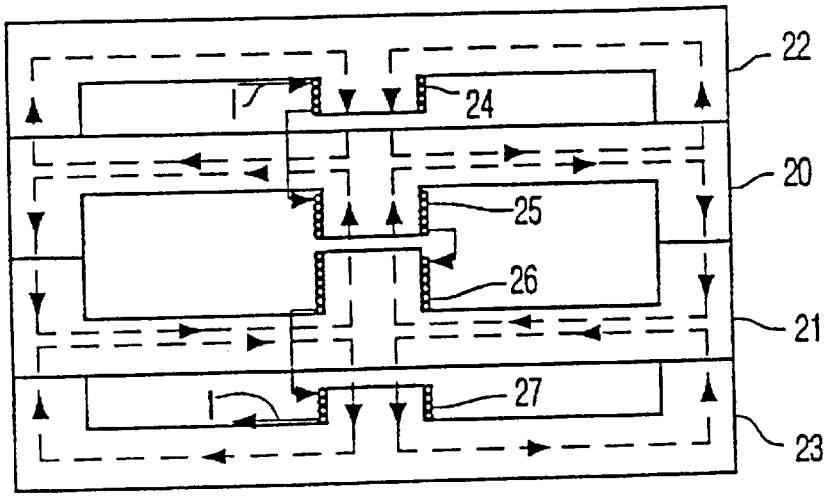
FIG. 3 shows a magnetic component according to the invention having a core comprising four E core halves and FIG. 4 shows a magnetic component according to the invention with which windings have also been deposited on the outside limbs.

A further improved reduction of the outside stray field is found in the magnetic component shown in FIG. 3. This has a core formed by four E core halves. First an E core is provided formed in customary fashion by two core halves 20 and 21, while on the outside of the core half 20 an E core half 22 of a second E core is arranged and on the outside of the E core half 21, the second core half 23 of the second E core is put accordingly. The head ends of corresponding inside and outside core portions of the four E core halves are opposite each other and on one line. An air gap is provided between the inside limb portions of the two inside E core halves 20 and 21, between the inside limb portion of the E core half 22 and of the E core half 20, and between the inside limb portion of the E core half 23 and of the E core half 21. Electrically series-arranged windings 24, 25, 26 and 27 are arranged on the inside limb portions of all four E core halves 20, 21, 22 and 23 so that magnetic fluxes through the inside limb portions of the E core halves 20 and 21 have the same direction. Similarly, the magnetic fluxes through the inside limb portions of the E core halves 22 and 23 show the same direction. In the present example of embodiment with the symmetrical core arrangement which comprises four identical E core halves, the windings 24 to 27 carried by the respective inside limb portions have identical numbers of turns.

Figure 4:
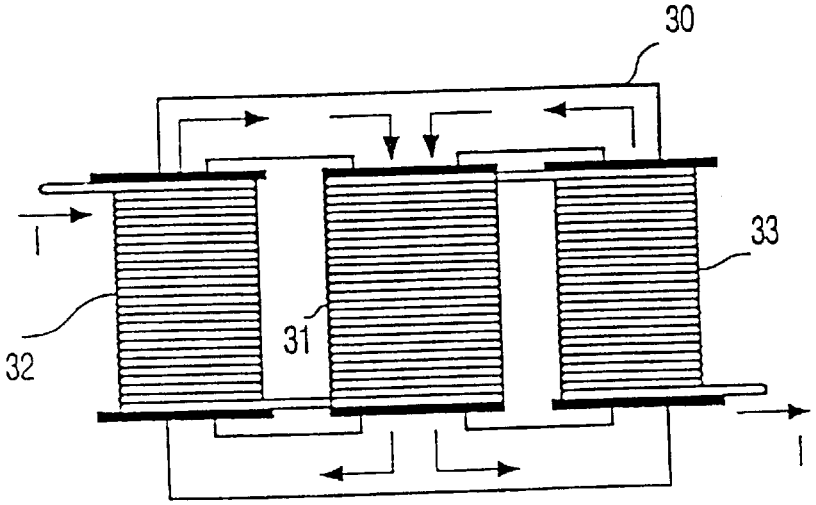

FIG. 4 represents a further variant of embodiment and shows a magnetic component with an E core 30, whose inside limb carries a winding 31 and whose two outside limbs carry windings 32 and 33. The windings 31 to 33 are electrically connected in series and wound so that magnetic fluxes run through the windings 32 and 33 in the same direction (in FIG. 4 from bottom to top) and that the respective magnetic flux runs in opposite direction through the middle winding 31 (in FIG. 4 from top to bottom). With this variant of embodiment it becomes clear that the inventive idea can be developed such that also the outside limb (portions) of a branched core of a magnetic component according to the invention can always carry part of the windings connected in series. This presents new possibilities of embodiment also for the variants of embodiment shown in FIGS. 1 to 3.

In lieu of E core portions, also portions of comparable types of cores, for example of P cores, can be used for the component according to the invention. Furthermore, the described embodiments may also be easily extended to transformers in the customary fashion.

What is claimed is:

1. A magnetic component comprising:

a winding, the winding consisting essentially of a single winding sub-divided into at least two spatially separated and magnetically decoupled winding portions electrically connected in series; and a core on which the winding is arranged, the core having at least one inside limb portion and at least two outside limb portions, the winding portions being arranged on at least one of the inside limb portion and the outside limb portions, and each of the individual winding portions having essentially the same inductance value, so that in the event of a current flow through the winding the generated magnetic stray fields outside the component at least partially compensate each other.

2. A magnetic component as claimed in claim 1, characterized in that two core portions (10, 11) are provided which have corresponding inside and outside limb portions, in that the inside limb portions carry each a winding (13, 14) and in that a third core portion (12) having an I shape in cross-section is provided for leading a magnetic flux between the two core portions (10 and 11).

3. A magnetic component as claimed in claim 1, characterized in that two inside core portions (20, 21) are provided which have inwardly directed corresponding inside and outside limb portions, in that further core portions (22, 23) having further inside and outside limb portions corresponding to the inside and outside limb portions of the inside core portions (20, 21) are provided on the outsides of the inside core portions (20, 21) and in that the windings (24–27) are arranged on the inside limb portions.

4. A magnetic component as claimed in claim 1 characterized in that the outside limb portions of the core (30) carry at least part (32, 33) of the windings (31–33).

5. A core for a magnetic component as claimed in claim 1.

* * * * *